US010820105B2

(12) United States Patent
Song

(10) Patent No.: US 10,820,105 B2
(45) **Date of Patent: *Oct. 27, 2020**

(54) SPEAKER

(71) Applicant: AAC Technologies Pte. Ltd., Singapore (SG)

(72) Inventor: Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/524,066

(22) Filed: Jul. 28, 2019

(65) Prior Publication Data

US 2020/0045429 A1 Feb. 6, 2020

(30) Foreign Application Priority Data

Aug. 4, 2018 (CN) ..... 2018 2 1252567 U

(51) Int. Cl.

| | |
|---|---|
| ***H04R 7/20*** | (2006.01) |
| ***H01F 7/08*** | (2006.01) |
| ***H04R 9/06*** | (2006.01) |
| ***H04R 9/02*** | (2006.01) |
| ***H01F 7/126*** | (2006.01) |

(52) U.S. Cl.

CPC ..... *H04R 7/20* (2013.01); *H01F 7/081* (2013.01); *H01F 7/126* (2013.01); *H04R 9/025* (2013.01); *H04R 9/06* (2013.01)

(58) Field of Classification Search

CPC . H04R 7/16; H04R 7/20; H04R 9/025; H04R 9/043; H04R 9/045; H04R 9/046; H04R 9/06; H04R 2307/207; H04R 9/066; H04R 2207/021; H04R 2499/11

USPC ..... 381/396, 401, 403, 404, 405, 407, 418, 381/431, 412

See application file for complete search history.

(56) References Cited

U.S. PATENT DOCUMENTS 5,123,053 A * 6/1992 House ..... H04R 9/06 181/157
6,778,677 B2 * 8/2004 Coffin ..... H04R 9/025 381/401
7,856,115 B2 * 12/2010 Clair ..... H04R 1/403 381/398

(Continued)

*Primary Examiner* — Fan S Tsang
*Assistant Examiner* — Julie X Dang
(74) *Attorney, Agent, or Firm* — W&G Law Group LLP

(57) ABSTRACT

The present disclosure provides a speaker having a lower magnetic conductive plate for carrying a magnet thereon and an upper magnetic conductive plate engaging with the lower magnetic conductive plate. The lower magnetic conductive plate includes a first oblique portion and a first horizontal portion for increasing an outer diameter of the lower magnetic conductive plate. The upper magnetic conductive plate includes a second oblique portion and a second horizontal portion both for increasing an outer diameter of the upper magnetic conductive plate. The lower and upper magnetic conductive plates cooperatively form a receiving space for accommodating a suspension to support a coil assembly. The lower magnetic conductive plate further includes a protruding portion extending perpendicularly from a middle portion of the bottom for carrying the magnet. The suspension is used for supporting the coil assembly for providing balanced vibration to the diaphragm.

10 Claims, 5 Drawing Sheets

(56) References Cited

U.S. PATENT DOCUMENTS

| | | | | |
|---|---|---|---|---|
| 10,631,092 | B2 * | 4/2020 | Song | H01F 7/126 |
| 2009/0161905 | A1 * | 6/2009 | Konuma | H04R 7/127 381/412 |
| 2019/0253781 | A1 * | 8/2019 | Kunimoto | H04R 7/12 |
| 2020/0100015 | A1 * | 3/2020 | Wang | H04R 9/045 |

* cited by examiner

A-A

B

SPEAKER

FIELD OF THE PRESENT DISCLOSURE

The present disclosure relates to the field of electromagnetic transducers, more particularly to a speaker used in a portable electronic device.

DESCRIPTION OF RELATED ART

A speaker is a very important component equipped in a mobile phone for producing audible sounds. A speaker generally uses a diaphragm to produce vibration and further to generate sounds.

In order to adapt to miniaturization and multifunctional development of various audio equipment and information communication equipment, the speaker used in the equipment is more likely to be more miniaturized. The matching of other elements on the periphery of the loudspeaker is more compact. The vibration system and the magnetic circuit system of the speaker are directly connected with the sound quality of the speaker. The vibration system of a related speaker comprises a vibrating diaphragm and a voice coil assembly attached to the vibrating diaphragm. The magnetic circuit system comprises a yoke and a magnet arranged in the yoke. The coil is fixedly supported by only the vibrating diaphragm, and when the vibrating system vibrates, unbalanced vibration is easily generated. The power is required to be reduced to meet the balance of the vibration system, and therefore the power of the vibration system is limited. So that the acoustic performance of the speaker using the vibration system is limited. Therefore, an improved speaker with more balanced vibration of the diaphragm and greater power capacity is desired.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby are only to explain the disclosure, not intended to limit the disclosure.

Embodiment 1

Figure 1:
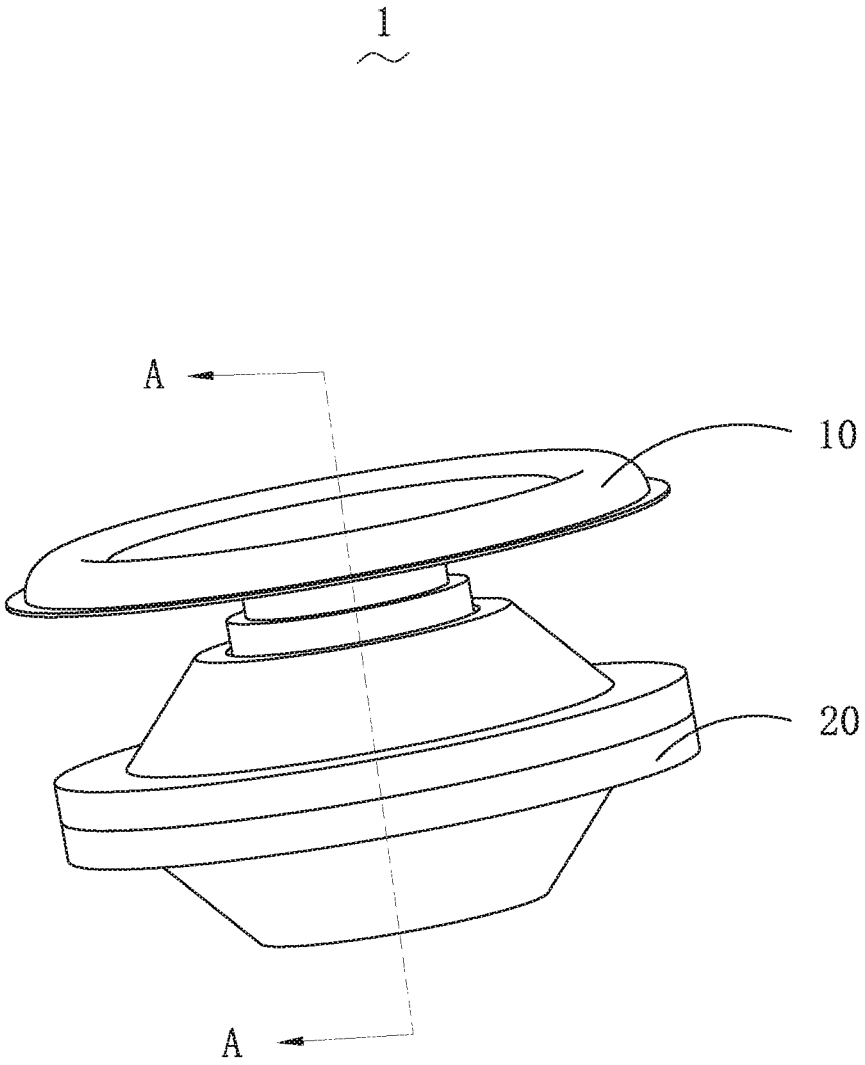
FIG. 1 is an isometric view of a speaker in accordance with a first exemplary embodiment of the present disclosure.
Figure 2:
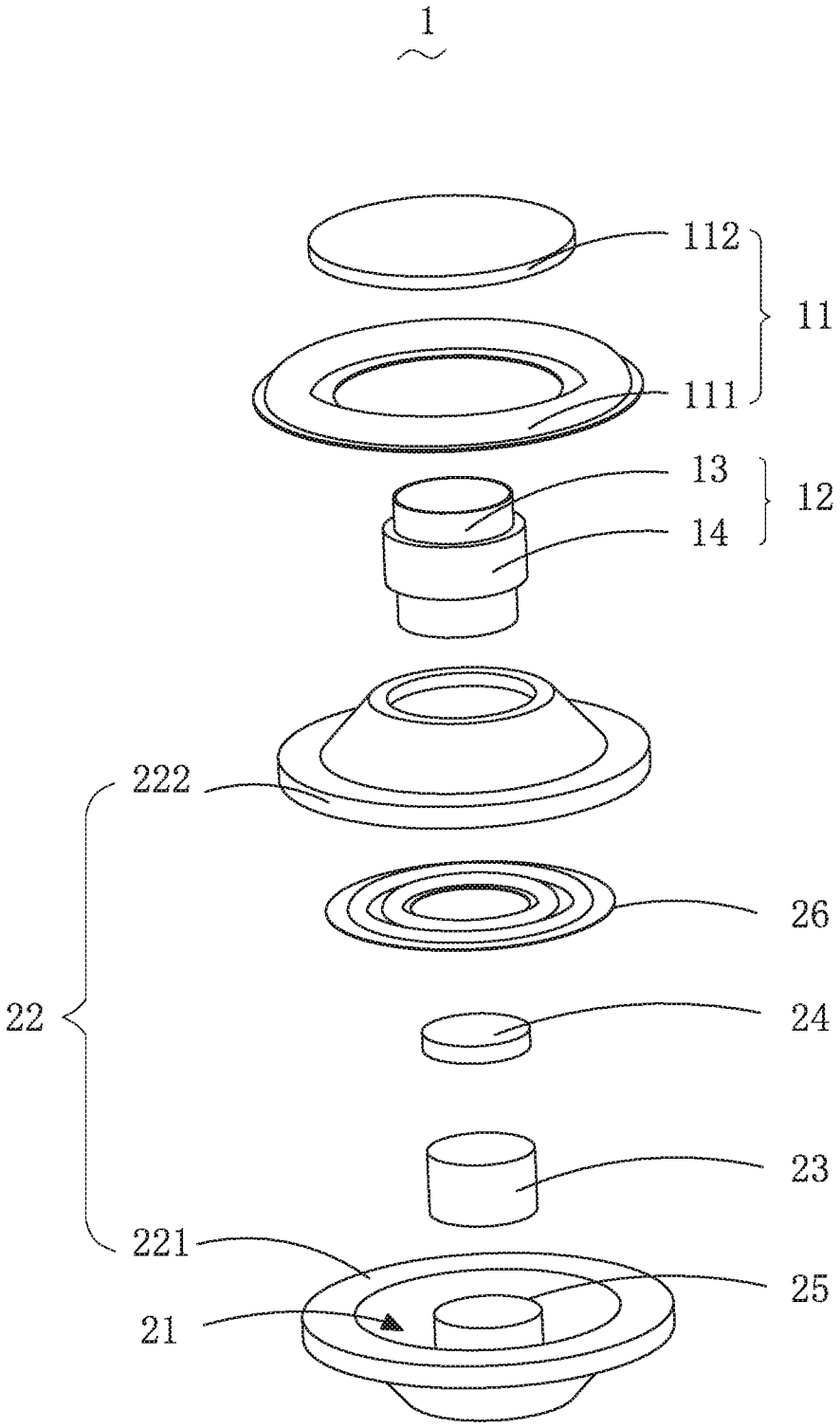
FIG. 2 is exploded view of the speaker in FIG. 1.

Referring to FIGS. 1-2, a speaker, in accordance with a first exemplary embodiment of the present disclosure, includes a vibration system 10 and a magnetic circuit system 20. The vibration system 10 includes a diaphragm 11 and a coil assembly 12 for driving the diaphragm 1. In the embodiment, the coil assembly 12 includes a frame 13 and a coil 14 wound around the frame 13. Alternatively, the coil assembly 12 may comprises only a coil. The diaphragm 11 includes a first suspension 111 and a dome 112 attached to/integral with the first suspension 111.

The magnetic circuit system 20 includes a magnetic conductive element 22 having a receiving space 21, a magnet 23 received in the receiving space 21, and a pole plate 24 covering the magnet 23. The magnetic conductive element 22 forms a magnetic gap together with the magnet 23. The coil assembly surrounds at least a part of the magnet 23. In the embodiment, the frame 13 partially surrounds the magnet 23. When electrified, the coil 14 will be actuated by the magnetic field produced in the magnetic gap and force the diaphragm 11 to vibrate for generating sound.

Figure 3:
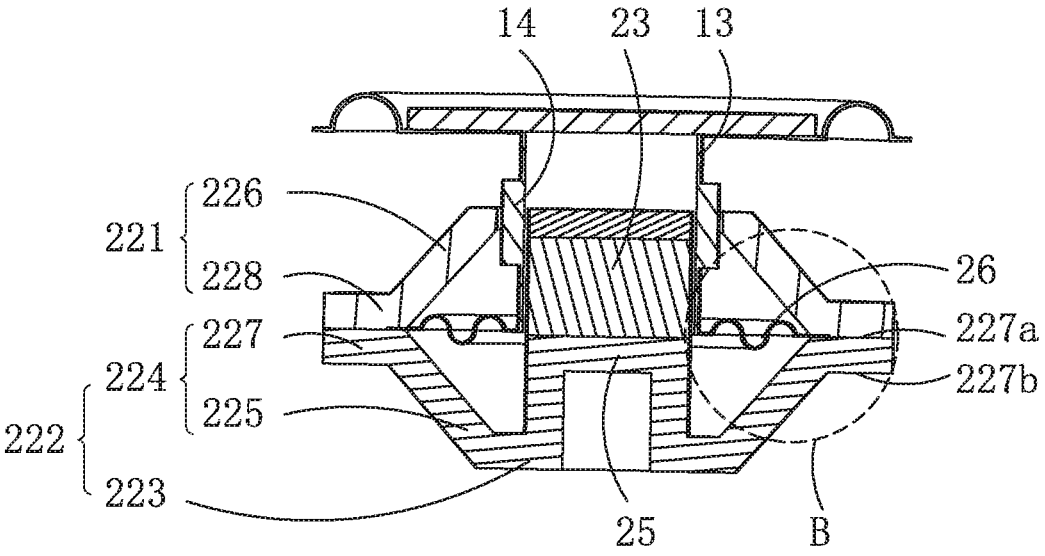
FIG. 3 is a cross-sectional view of the speaker in FIG. 1, taken along line A-A.
Figure 4:
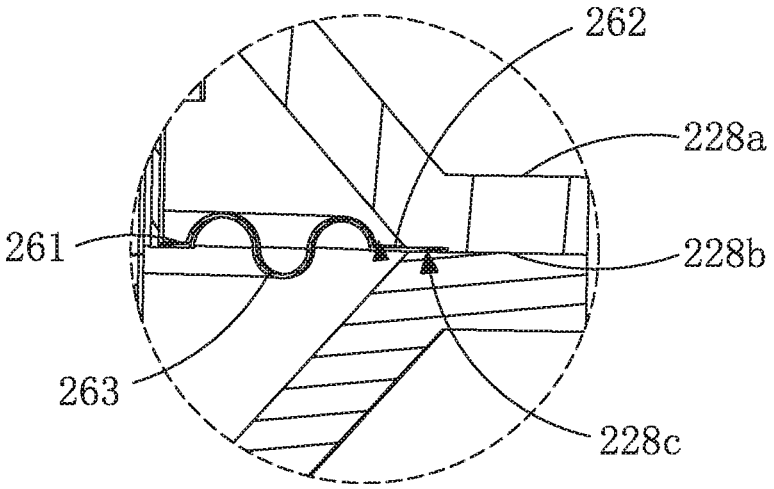
FIG. 4 is an enlarged view of Part B in FIG. 3.

Referring to FIGS. 3-4, the magnetic conducive element 22 includes an upper magnetic conductive plate 221 adjacent to the diaphragm 11 and a lower magnetic conductive plate 222 away from the diaphragm 11. The upper magnetic conductive plate 221 and the lower magnetic conductive plate 222 cooperatively form the receiving space 21. The lower magnetic conductive plate 222 includes a bottom 223 and a supporting portion 224 extending from the bottom 223. The supporting portion 224 further includes a first oblique part 225 outwardly extending from the bottom 223 toward the diaphragm. The upper magnetic conductive plate 221 includes a second oblique portion 226 engaging with the first oblique portion 225 and extending inwardly from the first oblique portion 225 toward the diaphragm 11. The lower magnetic conductive plate 222 further includes a protruding portion 25 extending perpendicularly from a middle portion of the bottom 223 toward the diaphragm 11 for carrying the magnet 23 thereon. A projection of the protruding portion 25 along a vibration direction of the diaphragm 11 locates completely within the bottom 223, and the projection of the protruding portion 25 along the vibration direction coincide with a projection of the magnet 23 along the vibration direction. In the embodiment, the supporting portion 224 further includes a first horizontal portion 227 extending from the first oblique portion 225 outwardly, and the upper magnetic conductive plate 221 further includes a second horizontal portion 228 extending from the second oblique portion 226 outwardly. The first horizontal portion 227 engages with the second horizontal portion 228. To put it simply, the first oblique portion 225 and the first horizontal portion 227 are used for increasing the outer diameter of the lower magnetic conductive plate 222, and the second oblique portion 226 and the second horizontal portion 228 is used for increasing the outer diameter of the upper magnetic conductive plate 221. Optionally, the first horizontal portion 227 has a projection along the vibration direction coinciding with a projection of the second horizontal portion 228 along the vibration direction. A projection of the first oblique portion 225 along the vibration direction coincide with a projection of the second oblique portion 226 along the vibration direction. Further, the projection of the second oblique portion 226 along a direction perpendicularly to the vibration direction at least partially falls on the coil assembly 12. And, the pole plate further has a projection along a direction perpendicularly to the vibration direction at least partially falls on the second oblique portion 226.

Referring to FIG. 4, a second suspension 26 is disposed in the receiving space 21 for supporting the coil assembly 12. The second suspension 26 includes a first fastening portion 261, a second fastening portion 262 and a connecting portion 263 between the first and second fastening portions 261, 262. The first fastening portion 261 connects to one end of the coil assembly 12 in the magnetic gap, and the second fastening portion 262 sandwiched between the first and second horizontal portions 227, 228. Particularly, the second suspension 26 has a waved cross-section taken along the vibration direction. In alternative embodiment, the cross-section of the second suspension may be a straight line, or be an arc.

Figure 5:
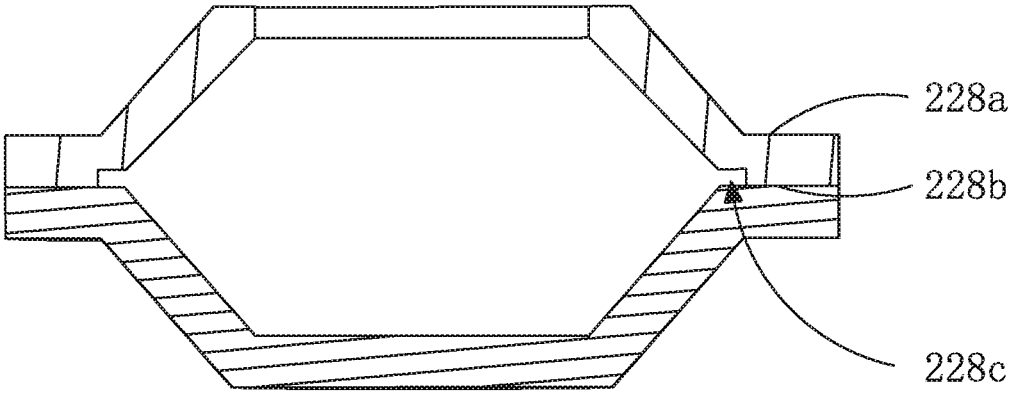
FIG. 5 is a cross-sectional view of a magnetic conductive element of the speaker of the first exemplary embodiment.

Referring to FIG. 5, together with FIGS. 3-4, the second horizontal portion 228 further includes a fastening slot 228*c* for more firmly fixing the second fastening portion 262. Particularly, the first horizontal portion 227 includes a first upper surface 227*a* adjacent to the second horizontal portion 228 and a first lower surface 227*b* opposite to the first upper surface 227*a*. The second horizontal portion 228 includes a second lower surface 228*b* adjacent to the first upper surface 227*a* and a second upper surface 228*a* opposite to the second lower surface 228*b*. The fastening slot 228*c* is formed in the second horizontal portion 228 by recessing from the second lower surface 228*b* toward the second upper surface 228*a*. In this embodiment, the fastening slot 228*c* is defined as a second fastening slot.

Embodiment 2

Figure 6:
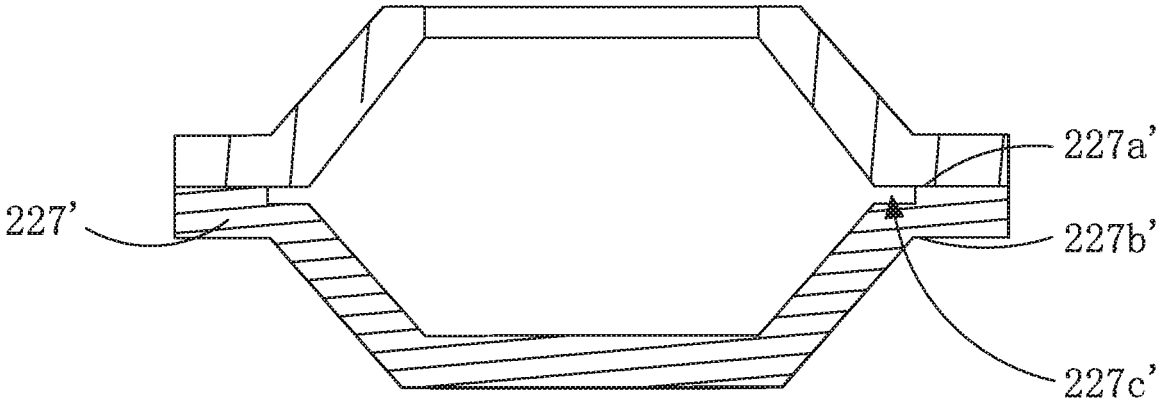
FIG. 6 is a cross-sectional view of a magnetic conductive element of a speaker in accordance with a second exemplary embodiment.

Referring to FIG. 6, a second embodiment of the present disclosure is shown. What is different from Embodiment 1 is that only the first horizontal portion 227' includes a first fastening slot 227*c*' recessed from the first upper surface 227*a*' toward the first lower surface 227*b*' for fixing the second suspension 26'. What is different from the first embodiment is that the fastening slot is formed in the first horizontal portion.

Embodiment 3

Figure 7:
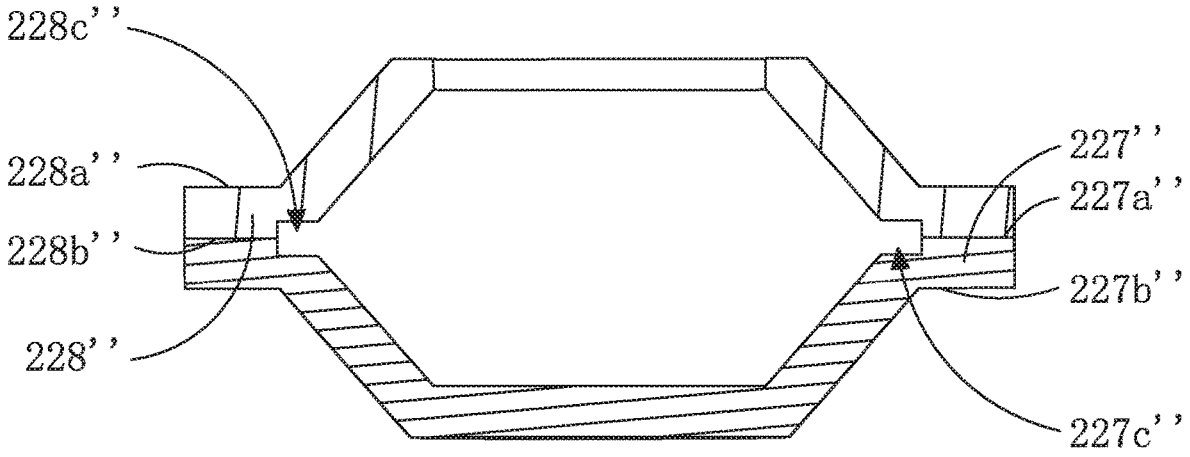
FIG. 7 is a cross-sectional view of a magnetic conductive element of a speaker in accordance with a third exemplary embodiment.

Referring to FIG. 7, what is different from Embodiment 1 is that the fastening slot is cooperatively formed by a first slot 227*c*" formed in the first horizontal portion 227" and a second slot 228*c*" formed in the second horizontal portion 228". Specifically, the first horizontal portion 227" includes a first slot 227*c*" recessed from the first upper surface 227*a*" toward the first lower surface 227*b*", and the second horizontal portion 228" includes a second slot 228*c*" recessed from the second lower surface 228*b*" toward the second upper surface 228*a*".

The present disclosure provides a speaker having a magnetic conductive element including a lower magnetic conductive plate for carrying a magnet thereon and an upper magnetic conductive plate engaging with the lower magnetic conductive plate. The lower magnetic conductive plate includes a first oblique portion and a first horizontal portion extending from the first oblique portion both for increasing an outer diameter of the lower magnetic conductive plate. The upper magnetic conductive plate includes a second oblique portion and a second horizontal portion both for increasing an outer diameter of the upper magnetic conductive plate. The lower and upper magnetic conductive plates cooperatively form a receiving space for accommodating a suspension to support a coil assembly. The suspension is used for supporting the coil assembly for providing balanced vibration to the diaphragm.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, comprising:

a vibration system including diaphragm and a coil assembly for driving the diaphragm;

a magnetic circuit system including a magnetic conductive element having a receiving space and a magnet supported by the magnetic conductive element;

a magnetic gap formed by the magnet and the magnetic conductive element;

the magnetic conductive element comprising:

a lower magnetic conductive plate for supporting the magnet, including a bottom, a first oblique portion extending outwardly from the bottom;

an upper magnetic conductive plate engaging with the lower magnetic conductive plate for forming the receiving space, including a second oblique portion engaging with the first oblique portion;

a suspension sandwiched between the first oblique portion and the second oblique portion, the suspension connecting to one end of the coil assembly; wherein the lower magnetic conductive plate further includes a protruding portion extending perpendicularly from a middle portion of the bottom for carrying the magnet.

2. The speaker as described in claim 1, wherein a projection of the protruding portion along a vibration direction of the diaphragm locates completely within the bottom.

3. The speaker as described in claim 2, wherein a projection of the magnet along a vibration direction of the diaphragm coincide with a projection of the protruding portion along the vibration direction of the diaphragm.

4. The speaker as described in claim 1, wherein the first oblique portion further includes a first horizontal portion extending from the first oblique portion outwardly, and the upper magnetic conductive plate further includes a second horizontal portion extending from the second oblique portion outwardly for engaging with the first horizontal portion.

5. The speaker as described in claim 4, wherein the first horizontal portion has a projection along the vibration direction coinciding with a projection of the second horizontal portion along the vibration direction; a projection of the first oblique portion along the vibration direction coincides with a projection of the second oblique portion along the vibration direction.

6. The speaker as described in claim 4, wherein the suspension includes a first fastening portion, a second fastening portion and a connecting portion between the first and second fastening portions; the first fastening portion connects to one end of the coil assembly, and the second fastening portion sandwiched between the first and second horizontal portions.

7. The speaker as described in claim 4, wherein the first horizontal portion includes a first upper surface adjacent to the second horizontal portion and a first lower surface opposite to the first upper surface; the second horizontal portion includes a second lower surface adjacent to the first upper surface and a second upper surface opposite to the second lower surface; the first horizontal portion includes a first fastening slot recessed from the first upper surface toward the first lower surface, and/or the second horizontal portion includes a second fastening slot recessed from the second lower surface toward the second upper surface; and wherein the second fastening portion of the suspension is fixed in the first fastening slot and/or in the second fastening slot.

8. The speaker as described in claim 6, wherein the suspension includes a waved cross-section taken along the vibration direction.

9. The speaker as described in claim 6, wherein the coil assembly includes a frame and a coil wound around the frame.

10. The speaker as described in claim 9, wherein the frame of the coil partially surrounds the magnet.

* * * * *